US010898901B2

(12) United States Patent
Knippschild et al.

(10) Patent No.: US 10,898,901 B2
(45) Date of Patent: Jan. 26, 2021

(54) TEMPERATURE-CONTROL DEVICE HAVING A REACTION VESSEL

(71) Applicant: Analytik Jena AG, Jena (DE)

(72) Inventors: Claus Knippschild, Jena (DE); Robert Moeller, Jena (DE)

(73) Assignee: Analytik Jena AG, Jena (DE)

( * ) Notice: Subject to any disclaimer, the term of this patent is extended or adjusted under 35 U.S.C. 154(b) by 230 days.

(21) Appl. No.: 16/060,528

(22) PCT Filed: Dec. 5, 2016

(86) PCT No.: PCT/DE2016/100567

§ 371 (c)(1),
(2) Date: Jun. 8, 2018

(87) PCT Pub. No.: WO2017/097289

PCT Pub. Date: Jun. 15, 2017

(65) Prior Publication Data

US 2018/0361387 A1 Dec. 20, 2018

(30) Foreign Application Priority Data

Dec. 8, 2015 (DE) ..... 10 2015 121 362

(51) Int. Cl.
*B01L 7/00* (2006.01)
*B01L 7/04* (2010.01)
(Continued)

(52) U.S. Cl.
CPC ..... *B01L 7/52* (2013.01); *F27B 5/14* (2013.01); *F27B 5/18* (2013.01);
(Continued)

(58) Field of Classification Search
CPC ..... B01L 7/52
See application file for complete search history.

(56) References Cited

U.S. PATENT DOCUMENTS 3,764,780 A * 10/1973 Ellis ..... G05D 23/275 219/430
5,616,301 A 4/1997 Moser et al.
(Continued)

FOREIGN PATENT DOCUMENTS

CN 2634859 Y 8/2004
DE 92 05 824.8 U1 9/1992
(Continued)

OTHER PUBLICATIONS

Machine translation of DE 9205824, Shulz 1992, provided by Espacenet (Year: 1992).*
(Continued)

*Primary Examiner* — Holly Kipouros
(74) *Attorney, Agent, or Firm* — Christopher R. Powers; Endress+Hauser (USA) Holding Inc.

(57) ABSTRACT

A temperature-control device for receiving a reaction vessel having a heat-insulated interior space and which is covered by a lid. The reaction vessel has a hollow body and a cap, this hollow body being closed on one side by a base. The base contacts a heatable heating block in order to heat a sample located in the reaction vessel. The hollow body is surrounded by a heatable heating body which communicates with the lid via a heat-conducting contact region so that the heating body heats the hollow body directly and heats the cap indirectly via the lid.

7 Claims, 1 Drawing Sheet

(51) Int. Cl.

| | |
|---|---|
| ***B01L 9/00*** | (2006.01) |
| ***B01L 9/06*** | (2006.01) |
| ***F27B 5/14*** | (2006.01) |
| ***F27B 5/18*** | (2006.01) |
| *C12Q 1/6806* | (2018.01) |
| *C12Q 1/686* | (2018.01) |

(52) U.S. Cl.
CPC ... *B01L 2200/025* (2013.01); *B01L 2200/028* (2013.01); *B01L 2300/041* (2013.01); *B01L 2300/18* (2013.01); *B01L 2300/1827* (2013.01); *B01L 2300/1883* (2013.01); *F27B 2005/143* (2013.01)

(56) References Cited

U.S. PATENT DOCUMENTS

| | | | | |
|---|---|---|---|---|
| 6,558,947 | B1 | 5/2003 | Lund et al. | |
| 2002/0072112 | A1* | 6/2002 | Atwood | B01L 3/50851 435/303.1 |
| 2004/0065655 | A1 | 4/2004 | Brown et al. | |
| 2008/0057544 | A1 | 3/2008 | Lem et al. | |
| 2008/0254532 | A1 | 10/2008 | Chang et al. | |
| 2009/0283512 | A1* | 11/2009 | Huhn | B01L 7/52 219/522 |
| 2013/0078735 | A1* | 3/2013 | Sandra | G01N 1/34 436/175 |
| 2015/0225765 | A1* | 8/2015 | Thompson | B01L 7/00 435/18 |

FOREIGN PATENT DOCUMENTS

| | | | |
|---|---|---|---|
| EP | 0 642 831 | A1 | 3/1995 |
| EP | 0 706 649 | B1 | 1/2001 |
| WO | WO 98/43740 | A2 | 10/1998 |
| WO | WO 2009/100933 | A1 | 8/2009 |

OTHER PUBLICATIONS

Keller, M., et al.; "Centrifugo-thermopneumatic aliquoting on LabDisk for DNA-based detection of different bacteria"; Mikrosystemtechnik Kongress 2013; pp. 31-34.
German Examination Report for 10 2015 121 362.1.
International Search Report for PCT/DE2016/100567 dated Mar. 6, 2017.

* cited by examiner

TEMPERATURE-CONTROL DEVICE HAVING A REACTION VESSEL

RELATED APPLICATIONS

The present application is a U.S. National Stage application of International PCT Application No. PCT/DE2016/100567 filed on Dec. 5, 2016 which claims priority benefit of German Application No. DE 10 2015 121 362.1 filed on Dec. 8, 2015, the contents of each are incorporated by reference in their entirety.

FIELD OF THE INVENTION

A principal technique for analysis of nucleic acids is the polymerase chain reaction, referred to generally as PCR. In this technique, the nucleic acids are reproduced by incubating them in a specific reagent mixture at defined temperatures until a finished PCR product emerges. At present, this is routinely carried out in special temperature-control devices known as thermocyclers which usually incubate in parallel a larger quantity of samples (e.g., 24, 48 or 96) placed in a reaction vessel comprising tubes, which are closed at one end, and a cap. These thermocyclers are usually constructed on a relatively large scale as tabletop units and are not designed for analyzing individual samples.

BACKGROUND OF THE INVENTION

In order to analyze the finished PCR product, the latter must be transferred to an appropriate analyzing device. To this end, the caps are removed from the reaction vessels and the PCR product is subsequently drawn up with a pipette and transferred. Alternatively, the reaction vessels can also be closed with sheeting and the reagent mixture can be covered with overlay media (oil, liquid wax, chill-out wax, etc.). In order to transfer the reagent mixture and the finished PCR product, the sheeting and overlay media, if any, are pierced with the tip of a pipette, a hollow needle or the like. A buffer can also be added to the mixture in this way. The resulting mixture is often heated again after pipetting up.

For pick-up or dispensing by pipetting, the reaction vessels are removed from the thermocycler and, in case additional heating is necessary, reinserted in the thermocycler.

In order to prevent condensation of the sample at the cap of the reaction vessel during PCR, thermocyclers of the type mentioned above are outfitted with a lid-heating device. For example, a temperature-control device, in this case a metal block thermostat, with a cover completely covering sample receptacles inserted into a metal block is known from DE 92 05 824 U1. The cover can be heated either indirectly via a good thermal contact with the metal block or directly via heating elements provided at the cover. Preventing condensation at the lids of the sample receptacles is mentioned as a critical effect for heating. For indirect heating, there is the drawback that the temperature profile of the cover depends on the heating of the metal block. Enabling the lid of the sample receptacle to actually be heated to the same temperature as the sample in the sample receptacle requires a large expenditure on insulation to prevent any heat loss en route to the lid. In practice, the temperature of the lid will always be at least slightly below the temperature of the metal block so that condensation cannot be completely prevented. Regardless of whether the cover is directly heated or indirectly heated, the sample receptacles are positioned in the temperature-control device such that the heated cover is pressed directly on the lid of the sample receptacle in order to heat the lid to a corresponding temperature via heat conduction.

A temperature-control device, in this case a thermocycler for performing PCR as presented in WO 98/43740 A1, is intended to solve the problem that heating samples which are arranged together in a sample block in a reaction vessel are heated differently. It is suggested, inter alia, that a circumferential heating device be arranged around the sample block. The circumferential heating device is not connected to the sample block. It is only meant to heat the air in the immediate vicinity to the temperature of the sample block if possible. Further, the device has a heated lid. Pressure is exerted on the caps of the reaction vessels by the heated lid so that the reaction vessels remain tightly closed on the one hand and, on the other hand, have a good thermal contact with the sample block via which the base of the reaction vessel and, therefore, the sample are heated. The heating plate integrated in the lid is controlled in such a way that it always reaches a temperature above the sample temperature in order to ensure that the sample does not condense on the cap of the reaction vessel. The heating plate has recesses in which possible curvatures of the caps can be positioned so that no direct pressure is exerted on these caps and deformation of the caps is prevented. When the closure caps are constructed in this way, they can be allotted an optical function in addition to the function of closing the reagent vessel, so that a finished PCR product can be accessed by an optical reading device without removing or exchanging the closure cap, and the sample is optically accessible through the respective recess.

A temperature-control device by which the progress of the nucleic acid amplification can be visually monitored is disclosed in EP 0 706 649 B1. Associated with this temperature-control device is a reaction chamber comprising a tube which is closed on one side and in which is located the reaction mixture to be visually monitored and comprising a cap. In order to prevent condensation of the reaction mixture on walls of the reaction chamber which are situated in the optical path of the device, these walls are heated. In the embodiment example shown here, the cap is the part of the wall which is located in the optical path. It is heated indirectly via a thermally conductive board (printed circuit board) by a heating element without the board or heating element limiting the optical path.

Aside from parallel incubation and implementation of PCR of increasingly more samples such as can be carried out, for example, with a temperature-control device known from WO 98/43740 A2, cited above, various applications in which PCR is carried out only on an individual sample have also become established in recent years.

Using a temperature-control device for this purpose, particularly a thermocycler designed to receive a plurality of reaction vessels, is inadvisable in view of the disproportionately high initial costs as well as the space requirement and energy requirement.

The additional work step of opening the thermocycler to remove or insert the reaction vessel after or before drawing up or dispensing by pipette exacerbates the disproportionality even more because each time the thermocycler is opened or closed a disproportionately large spatial volume must be adjusted again to a defined temperature.

Publication US 2008/0254532A1 discloses a temperature-control device for a symmetrical chemical reaction chamber with an inner volume for receiving a sample and with a closable inlet. The reaction chamber resides in a carrier housing with a thin, flexible material wall which has heating elements which give off heat to the circumferential surface of the reaction chamber.

Publication U.S. Pat. No. 6,558,947 B1 shows a further temperature-control device for implementing PCR. It includes a plurality of sleeves into which reaction vessels are inserted and which are individually heatable over their circumferential surfaces.

Publication US 2008/0057544 A1 discloses a temperature-control device with a divisible heating block with which heating of reaction vessels is likewise carried out over the circumferential surfaces thereof.

Publication G 92 05 824 U1 discloses a metal block thermostat with a metal block into which a plurality of sample vessels can be inserted and with a cover which can be removed from the meal block. The cover can be heated independently from the metal block or can be heated through thermal contact with the metal block.

DESCRIPTION OF THE INVENTION

It is an object of the invention to provide a temperature-control device with only one reaction vessel in which it is possible to pick up or dispense a sample by pipetting without removing the reaction vessel from the temperature-control device.

This object is met for a temperature-control device having a reaction vessel with a heat-insulated interior space which is covered by a lid and receives the reaction vessel, wherein the reaction vessel comprises a hollow body and a cap, this hollow body being symmetrical with respect to an axis of symmetry and closed on one side by a base. A heatable heating block is provided in the interior space. It has an inner surface which is adapted to the base of the reaction vessel and contacts the latter in order to heat a sample located in the reaction vessel. The lid comprises a heat-conducting material, is covered by a heat-insulating cover and contacts the cap. The heat-conductivity of the heat-insulating cover is compulsorily less than that of the heat-conducting material of the lid. It is key to the invention that a heatable heating body is provided which encloses the hollow body and is adapted to the shape of the hollow body. The heating body communicates with the lid via a heat-conducting contact region so that the heating body heats the hollow body directly and heats the cap indirectly via the lid. The lid has a hole through which a hollow needle can be inserted through the cap into the hollow body.

The contact region is advantageously formed by a cone-shaped outer surface of the heating body and by a cone-shaped outer surface of the lid.

The outer surface of the heating body is advantageously arranged on the inside, i.e., facing the hollow body.

It is advantageous when the heating body is formed at least by two heating body shells which are arranged symmetrically with respect to the axis of symmetry and the heating body shells are supported in the interior space via at least one spring element so that the heating body shells contact the hollow body with a restoring force of the at least one spring element.

The heating body shells are advantageously held together via at least one elastic ring.

It is likewise advantageous when the lid is formed of two lid shells which bear resiliently against one another.

BRIEF DESCRIPTION OF THE DRAWINGS

The invention will be described herein with reference to an exemplary embodiment in connection with the drawings, in which.

DETAILED DESCRIPTION OF THE DRAWINGS

Figure 1A:
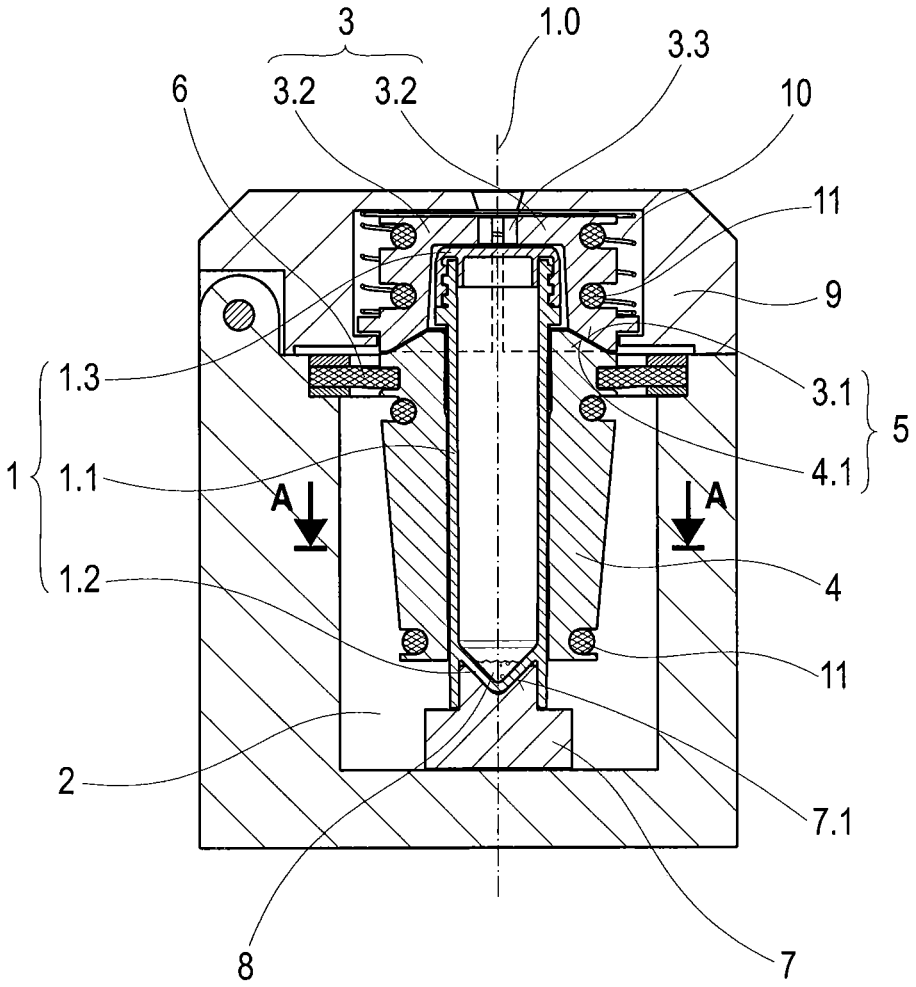
FIG. 1*a* is an illustration of a temperature-control device in longitudinal direction.
Figure 1B:
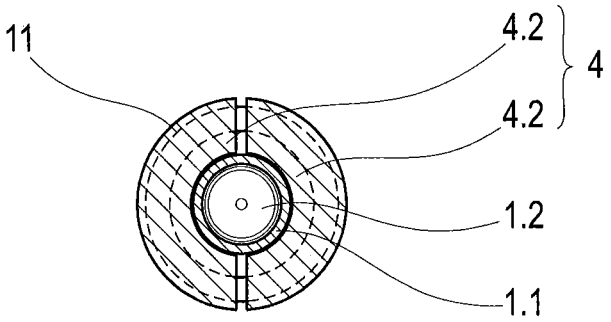
FIG. 1*b* is an illustration of a temperature-control device according to FIG. 1*a* in cross section.

A temperature-control device according to the invention which is shown, for example, in FIGS. 1*a* and 1*b*, is designed specifically for a reaction vessel 1; that is, it is individually adapted to the geometric shape and dimensions of the reaction vessel 1 and so cannot be used in an all-purpose manner in conjunction with a reaction vessel of any shape or dimensions. Correspondingly, the characteristic features of the temperature-control device can also be described only in connection with a reaction vessel 1.

Reaction vessel 1 comprises a hollow body 1.1 and a cap 1.3. The hollow body 1.1 is symmetrical with respect to an axis of symmetry 1.0 and is closed on one side by a base 1.2.

The temperature-control device is not limited to use for PCR. Accordingly, the expression "sample" is intended to include hereinafter cell suspensions, reagent mixtures, e.g., comprising reactants and catalysts, and finished PCR products in liquid form. Such sample is referenced in FIG. 1*a* as numeral 8.

The temperature-control device has a heat-insulated interior space 2 which is closed by a lid 3 and in which there is provided a heatable heating block 7 which has an inner surface 7.1 which is adapted to the base 1.2 of the reaction vessel 1. The reaction vessel 1 is arranged upright on the heating block 7 such that its base 1.2 contacts the inner surface 7.1 in order to heat a sample 8 located in the reaction vessel 1. The lid 3 is made of a heat-conducting material, is covered by a heat-insulating cover 9 and abuts the cap 1.3.

It is key to the invention that there is provided a heatable heating body 4 which surrounds the hollow body 1.1, is adapted to the shape of the latter and communicates with the lid 3 via a heat-conducting contact region 5 such that the heating body 4 heats the hollow body 1.1 directly and heats the cap 1.3 indirectly via the lid 3.

With a temperature-control device, according to the invention, which embodies a thermocycler in connection with PCR, it is possible to introduce a hollow needle, a detection probe, a mixing rod, a pipette tip or the like through the lid 3 of the temperature-control device and through the cap 1.3 of the reaction vessel 1 so as to extract or dispense the sample by pipette, detect the sample or mix the sample without opening the temperature-control device. Since the lid 3 remains closed during this process, the defined spatial climate in the temperature-control device is also preserved. The work step of removing and possibly reinserting into the temperature-control device is dispensed with. Further, the temperature-control device according to the invention makes it possible to draw up by pipetting without additional means, which will be discussed later. The cap 1.3 advantageously has a screw closure and is filled with a septum.

In order to pick up and dispense by pipette when the temperature-control device is closed, it is key to the invention that the lid 3 has a hole 3.3. It is possible to provide a hole 3.3 of this kind in the lid 3 in an uncomplicated manner because the lid 3 according to the invention has no heating device but, rather, is heated through heat conduction via the heating body 4 with which it is in contact via the contact region 5 when the temperature-control device is closed. Accordingly, the heating of the lid 3 is not carried out by means of active heating but rather passively via heat conduction. Since the lid 3 abuts the cap 1.3 at least via the area of the hole 3.3, the interior space 2 of the temperature-control device is closed in spite of the hole 3.3.

The contact region 5 is formed by an outer surface 4.1 of the heating body 4 and by an outer surface 3.1 of the lid 3. In simplest form, the outer surface 4.1 of the heating body 4 and the outer surface 3.1 of the lid 3 are arranged annularly and in a radial plane with respect to the axis of symmetry 1.0. In order to form a larger contact region 5 for improved heat conduction, the outer surface 4.1 of the heating body 4 and the outer surface 3.1 of the lid 3 can be cone-shaped. The larger the cone angle, the greater the contact region 5 with the dimensions of the temperature-control device remaining the same. For purposes of closing the interior space 2 of the temperature-control device with the lid 3 in a simple manner, the outer surface 4.1 of the heating body 4 can be arranged inside the outer surface 3.1 of the lid 3.

The heating body 4 has the purpose not only of heating the lid 3 but also heating the hollow body 1.1 of the reaction vessel 1 and, therefore, the gas volume of the reaction vessel 1 which is compulsorily located above the sample 8. Condensation at the inner wall of the hollow body 1.1 is also primarily prevented in this way. Further, the pressure of the gas volume can be changed by changing the temperature, which is often utilized in fluidics and is known as the thermo-pneumatic effect. Therefore, manipulation (dispensing by pipette, aliquoting, mixing) of the sample is also possible without a pump [Keller, M.; Focke, M.; Strohmeier, O.; Reith, P.; Roth, G.; Mark, D.; Zengerle, R.; von Stetten, F., "Centrifugal thermo-pneumatic aliquoting on the Lab-Disk and application for DNA-based detection of various bacteria", *Mikrosystemtechnik Kongress* 2013, Aachen, 14.—Oct. 16, 2013, pages 31-34].

When a hollow needle is inserted into the sample 8, the latter is forced into the hollow needle accompanied by expansion of the gas volume. To this end, the hollow needle must be closed at the outer, first end during insertion until the inner, second end comes in contact with the sample 8. Then, when the first end is opened, the gas volume can expand in that the sample 8 rises in the hollow needle until the gas volume is at normal pressure and the sample 8 is completely drawn up. Accordingly, the heating body 4 surrounding the hollow body 1.1 allows not only the use of a passively heated lid 3, but also a quasi-passive removal of the sample 8.

The heating body 4 can be a tubular body, but advantageously comprises at least two heating body shells 4.2 which are arranged symmetrically with respect to the axis of symmetry 1.0. Exactly two heating body shells 4.2 in the form of half-shells are advantageous. While a tubular heating body 4 is arranged to be stationary within the interior space 2 with respect to the axis of symmetry 1.0, when the heating body 4 is constructed as two heating body shells 4.2, the two heating body shells 4.2 are supported in the interior space 2 radially elastically with respect to the axis of symmetry 1.0 via at least one spring element 6 and are held together via at least one elastic ring 11.

It is customary and also advantageous that the hollow body 1.1 of the reaction vessel 1 is cone-shaped and has a small cone angle so that when the reaction vessel 1 is introduced into the temperature-control device and, therefore, between the heating body shells 4.2, these heating body shells 4.2 are increasingly pressed apart while an increasingly large restoring force acts on the heating body shells 4.2, which ensures a snug fit of the heating body shells 4.2 against the hollow body 1.1. This restoring force is influenced by the elasticity and spring characteristic of the at least one elastic ring 11, e.g., a rubber ring, and of the at least one spring element 6.

In case the heating body 4 is constructed as two heating body shells 4.2, the lid 3 can advantageously likewise be produced from two lid shells 3.2, advantageously in the form of half-shells. For this purpose, as is shown in FIG. 1*a*, the outer surface 3.1 of the lid 3 and the outer surface 4.1 of the heating body 4 are advantageously cone-shaped. Then, when closing the lid 3, the lid shells 3.2 are spread apart and the outer surfaces 3.1 of the lid 3 are pressed against the outer surfaces 4.1 of the heating body 4 by restoring forces. In the embodiment example shown in FIG. 1*a*, the restoring forces are generated by a spiral spring 10 surrounding the lid shells 3.2.

If the lid 3 is made of one piece, the outer surface 3.1 of the lid 3 remains fixed in position with respect to the axis of symmetry 1.0, while the position of the outer surface 4.1 of the heating body 4 is displaced radially with respect to the axis of symmetry 1.0.

In the event that the outer surface 3.1 of the lid 3 and the outer surface 4.1 of the heating body 4 are constructed as annular surfaces, this only reduces the size of the contact region 5. When the outer surface 3.1 of the lid 3 and the outer surface 4.1 of the heating body 4 are constructed in a cone-shaped manner, the outer surface 3.1 of the lid 3 is placed at a different height on the outer surface 4.1 of the heating body 4 in axial direction of the axis of symmetry 1.0 depending on the extent to which the heating body shells 4.2 are spread apart, so that the lid 3 is axially resiliently supported in the cover 9.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

LIST OF REFERENCE NUMERALS

1 reaction vessel
1.0 axis of symmetry
1.1 hollow body
1.2 base
1.3 cap
2 interior space
3 lid
3.1 outer surface of the lid
3.2 lid shell
3.3 hole
4 heating body
4.1 outer surface of the heating body
4.2 heating body shell
5 contact region
6 spring element
7 heating block
7.1 inner surface
8 sample
9 cover
10 spiral spring
11 elastic ring

What is claimed is:

1. A temperature-control device for receiving a sample, comprising:

a housing defining a heat-insulated interior space;

a heat-insulating cover configured to cover the interior space;

a reaction vessel, said reaction vessel comprising a hollow body and a cap, said hollow body being symmetrical with respect to an axis of symmetry and closed on one side by a base;

a lid made of a heat-conducting material and configured to cover the reaction vessel and contact the cap;

a heating block disposed in said interior space and configured to actively heat the reaction vessel, said heating block having an inner surface which is adapted to the base of the reaction vessel and contacts the reaction vessel as to heat a sample located therein; and a heating body, which surrounds and contacts at least a portion of the hollow body, disposed in the interior space and configured to actively heat to the reaction vessel, the heating body adapted to the shape of the hollow body and in thermal communication with the lid via a heat-conducting contact region therebetween such that, in operation, the heating body heats the hollow body directly and heats the cap indirectly via the lid, wherein said lid includes a hole therethrough configured to enable a body to be introduced into the hollow body through the cap.

2. The temperature-control device according to claim 1, wherein the contact region is formed by a cone-shaped outer surface of the heating body and by a cone-shaped outer surface of the lid.

3. The temperature-control device according to claim 2, wherein the cone-shaped outer surface of the heating body is arranged on the inside of said lid.

4. The temperature-control device according to claim 1, wherein said heating body is formed at least by two heating body shells which are arranged symmetrically with respect to the axis of symmetry, and the heating body shells are supported in the interior space via at least one spring element so that the heating body shells contact the hollow body with a restoring force of the at least one spring element.

5. The temperature-control device according to claim 4, wherein said heating body shells are held together via at least one elastic ring.

6. The temperature-control device according to claim 5, wherein said lid is formed of two lid shells which bear resiliently against one another.

7. The temperature-control device according to claim 1, wherein the heat conductivity of the heat-insulating cover is less than that of the heat-conducting lid.

* * * * *